US006106876A

United States Patent [19]

Tipler et al.

[11] Patent Number: 6,106,876

[45] Date of Patent: Aug. 22, 2000

[54] FOODSTUFFS PRESERVING PACKAGING

[76] Inventors: Keith Charles Tipler, Sennock House, Coton Lane, Staffordshire ST18 9JY; Ivan Robert Tatt, 38, Hartlands Road, Eccleshall Stafford ST21 6DW, both of United Kingdom

[21] Appl. No.: 09/000,446

[22] PCT Filed: Aug. 2, 1996

[86] PCT No.: PCT/GB96/01887

§ 371 Date: Nov. 6, 1998

§ 102(e) Date: Nov. 6, 1998

[87] PCT Pub. No.: WO97/06074

PCT Pub. Date: Feb. 20, 1997

[30] Foreign Application Priority Data

Aug. 5, 1995 [GB] United Kingdom ..... 9516087

[51] Int. Cl.[7] ..... B65B 29/02

[52] U.S. Cl. ..... 426/133; 426/138; 426/110; 426/428; 426/106

[58] Field of Search ..... 426/138, 133, 426/428, 106, 110

[56] References Cited

U.S. PATENT DOCUMENTS

| | | | |
|---|---|---|---|
| 4,810,745 | 3/1989 | Pike et al. | 524/516 |
| 4,835,002 | 5/1989 | Wolf et al. | 426/590 |
| 5,017,397 | 5/1991 | Nguyen et al. | 426/542 |
| 5,126,174 | 6/1992 | Courtright et al. | 428/34.3 |
| 5,230,915 | 7/1993 | Shahidi et al. | 426/240 |
| 5,362,500 | 11/1994 | Mazurek et al. | 426/5 |
| 5,714,094 | 2/1998 | Bertholet et al. | 252/403 |

FOREIGN PATENT DOCUMENTS 701700 1/1951 United Kingdom .

OTHER PUBLICATIONS

Hawley, The Condensed Chemical Dictionary., Tenth edition., p. 918, 1981.

*Primary Examiner*—Milton Cano
*Assistant Examiner*—Philip DuBois
*Attorney, Agent, or Firm*—James E. Bradley

[57] ABSTRACT

A foodstuff preserving packaging comprising a packaging substrate having a layer of a bonding agent including at least one foodstuff preservative.

14 Claims, 1 Drawing Sheet

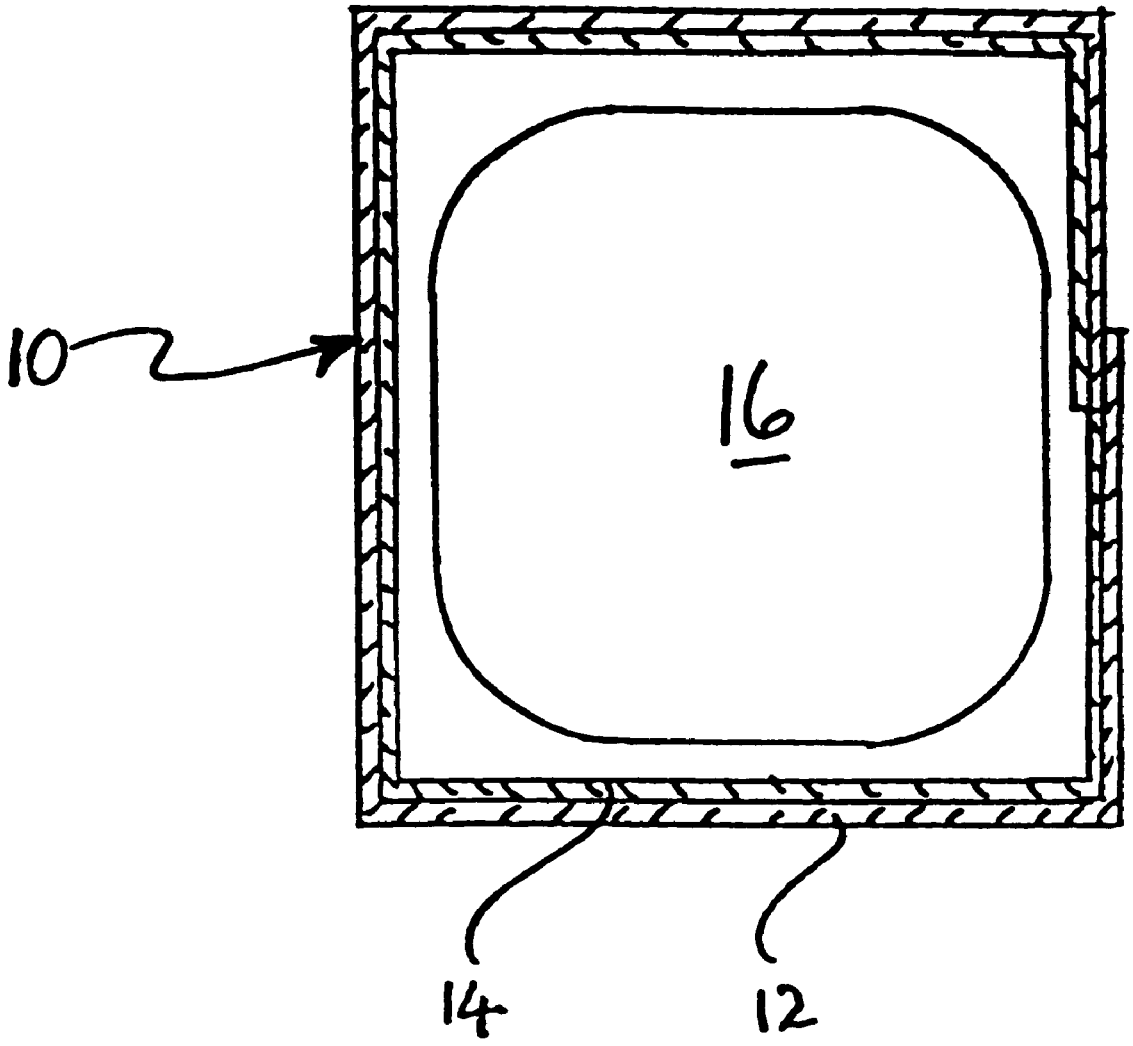
10
16
14
12

FOODSTUFFS PRESERVING PACKAGING

The present application is a 371 of PCT/GB96/01887 filed on Aug. 2, 1996.

BACKGROUND OF THE INVENTION

1. Field of the Invention

This invention relates to foodstuff packaging, in particular to forms of packaging that enhance the shelf life of the foodstuffs contained therein.

2. Description of the Related Art

The shelf life of foodstuffs is limited by the onset of deterioration processes, the result of which is wastage and loss of revenue for foodstuff retailers. Extension of existing shelf lifes, even by a day or so, would result in a substantial reduction in such wastage. This is particularly true for perishables, such as fruit and vegetables, where the shelf lifes are inherently rather short.

BRIEF SUMMARY OF THE INVENTION

It is an object of the present invention to provide a convenient and economical means of preserving foodstuffs.

According to the invention there is provided foodstuff preserving packaging comprising a packaging substrate having a layer of a bonding agent including at least one foodstuff preservative.

The packaging substrate may be plastic film, paper, cardboard or a woven material.

The volume-to-volume ratio of preservative or preservatives to bonding agent may exceed 9:1.

The bonding agent may be an organic lacquer such as shellac.

The foodstuff preservative may be an essential oil such as rosemary oil or thyme oil Both thyme oil and rosemary oil may be included in the layer of bonding agent.

The preserved foodstuff may be a perishable.

The layer may be coated onto the packaging substrate, and the coating may be performed using a printing technique. Designs or text may be simultaneously printed onto the substrate.

BRIEF DESCRIPTION OF THE DRAWING

The invention will be described, by way of example only, with reference to the single FIGURE on the accompanying drawing, which shows a cross section through a package.

The FIGURE shows foodstuffs preserving packaging 10 comprising a packaging substrate 12 having a layer 14 of a bonding agent including at least one foodstuff preservative. Contained within the packaging 10 is a foodstuff item 16.

DETAILED DESCRIPTION OF THE INVENTION

The packaging substrate 12 is preferably plastic film, although paper, cardboard or a woven material suitable for coating with the layer 14 may also be employed.

The bonding agent may be any substance that, when mixed with the foodstuff preservative, will bond the preservative to the packaging substrate 12 whilst allowing the preservative to act efficiently upon the foodstuff item 16. Fulfilment of the latter condition is advantageously achieved by maintaining a large excess of the preservative (or preservatives) in relation to the bonding agent. A volume-to-volume ratio of preservative or preservatives to bonding agent of ca. 9:1 or greater is considered a large excess in this context, although this should not be taken as excluding lower ratios from the scope of the invention. Organic lacquers may be employed as bonding agents, a preferred example being shellac.

The foodstuff preservative may be any substance that has a beneficial effect in prolonging the shelf life of the foodstuff item 16. Specific examples of foodstuff preservatives are provided by essential oils such as rosemary oil and thyme oil. Thyme oil absorbs carbon dioxide released by foodstuffs, whilst other essential oils such as rosemary oil absorb dioxins and also inhibit the growth of dioxin producing bacteria. Both carbon dioxide and dioxins cause deterioration of foodstuffs. A 95% rosemary oil/5% shellac (by volume) layer is suitable for use with a plastic film packaging substrate. Other foodstuff preservatives, such as anti-oxidants, are within the scope of the invention. It is also within the scope of the invention to employ more than one foodstuff preservative: for example, both thyme oil and rosemary oil may be advantageously combined within the layer 14.

The invention is primarily directed towards providing packaging for perishable items such as vegetables, since even a relatively modest extension of a day or so in the inherently short shelf lifes associated with such foodstuffs represents a substantial saving in wastage caused by the rejection of foodstuff items that are past their sell-by date. However, it should be noted that the packaging of other foodstuffs is within the scope of the invention.

The layer may be coated onto the packaging substrate by methods well known to those skilled in the art, with varying thickness and concentrations of preservative or preservatives. A preferred method of coating is by a printing technique in which a mixed solution of bonding agent and preservative or preservatives is applied, via metered rollers, to, for example, a plastic packaging film. It may prove desirable to simultaneously print text or designs, including logos, advertisements, nutritional information, instructions, etc., onto the film. The layer is subsequently dried.

It will be appreciated that it is not intended to limit the inventions to the above examples only, many variations, such as might readily occur to one skilled in the art, being possible without departing from the scope thereof.

What is claimed is:

1. Foodstuff preserving packaging for a preserved foodstuff, the foodstuff preserving packaging comprising a packaging substrate having a layer of a bonding agent including at least one food stuff preservative, wherein the volume-to-volume ratio of foodstuff preservative to bonding agent exceeds 9:1.

2. Packaging according to claim 1 in which the packaging substrate is plastic film.

3. Packaging according to claim 1 in which the packaging substrate is paper, cardboard or a woven material.

4. Packaging according to claim 1 in which the bonding agent is an organic lacquer.

5. Packaging according to claim 4 in which the bonding agent is shellac.

6. Packaging according to claim 1 in which the foodstuff preservative is an essential oil.

7. Packaging according to claim 6 in which the essential oil is rosemary oil.

8. Packaging according to claim 6 in which the essential oil is thyme oil.

9. Packaging according to claim 6 in which thyme oil and rosemary oil are included in the layer of bonding agent as anti-oxidants.

10. Packaging according to claim 1 in which the preserved foodstuff is a perishable.

11. Packaging according to claim 1 in which the layer is coated onto the packaging substrate.

12. Packaging according to claim 11 in which the layer is coated onto the packaging substrate by a printing technique.

13. Packaging according to claim 12 in which designs or text are simultaneously printed onto the substrate.

14. Packaging according to claim 6 in which the essential oil is included in the layer of bonding agent.

* * * * *